US006511591B1

(12) United States Patent
Virtanen et al.

(10) Patent No.: US 6,511,591 B1
(45) Date of Patent: Jan. 28, 2003

(54) METHOD FOR THE ELECTROLYTIC REFINING OF COPPER

(75) Inventors: Henri Virtanen, Pori (FI); Hannu Pouru, Pori (FI)

(73) Assignee: Outokumpu, Oyj (FI)

( * ) Notice: Subject to any disclaimer, the term of this patent is extended or adjusted under 35 U.S.C. 154(b) by 59 days.

(21) Appl. No.: 09/723,525

(22) Filed: Nov. 28, 2000

(30) Foreign Application Priority Data

Dec. 21, 1999 (FI) ..... 992739

(51) Int. Cl.[7] ..... C25C 1/12

(52) U.S. Cl. ..... 205/574; 205/585; 205/82; 205/103

(58) Field of Search ..... 205/103, 574, 205/585, 83; 204/228.1, 229.2, 229.4, 229.6, 229.8, 230.2

(56) References Cited

U.S. PATENT DOCUMENTS 4,146,437 A * 3/1979 O'Keefe ..... 205/574

* cited by examiner

*Primary Examiner*—Bruce F. Bell
(74) *Attorney, Agent, or Firm*—Morgan & Finnegan LLP

(57) ABSTRACT

The present invention concerns a method for the prevention of anode passivation in the electrolytic refining of copper, when periodic reversal current technology is used in electrolysis. The method is particularly suitable for the electrolytic refining of copper at high current densities. Irregular periodic reversal current technology is used in the present method, whereby current reversal is adjusted on the basis of an increase in electrolysis cell voltage.

5 Claims, 2 Drawing Sheets

METHOD FOR THE ELECTROLYTIC REFINING OF COPPER

Figure 1A:
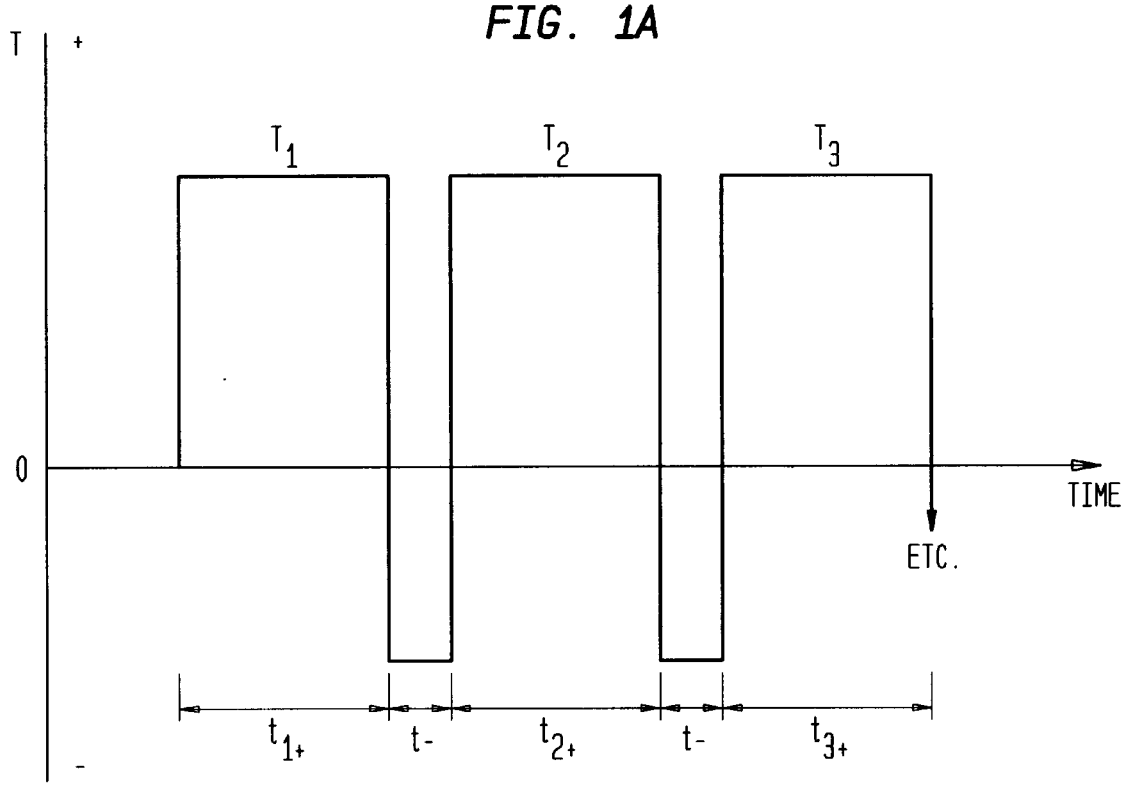

The present invention concerns a method for preventing anode passivation in the electrolytic refining of copper, when periodical current reversal technology (PCR) is applied in electrolysis. The method is particularly suitable where the electrolytic refining of copper is carried out at high current densities. Irregular periodical current reversal technology is applied in the method, whereupon current reversal is regulated on the basis of an increase in voltage in the electrolysis cell.

In the electrolytic refining of copper, the impure so-called anode copper is dissolved with the aid of an electrical current and the dissolved copper is reduced onto cathode plates as totally pure so-called cathode copper. The electrolyte used is a sulfuric acid-based copper sulfate solution. A copper starting sheet, or so-called permanent cathode is used as the cathode plate at the beginning of the process; this permanent cathode can be made of acid resistant steel or titanium. One or more rectifiers are used as the power source in the electrolysis. As a rule, the current densities used in electrolysis are 250–320 $A/m^2$ and the current is direct current (DC). Electrolysis takes place in separate electrolysis cells, where the number of anode-cathode pairs varies according to the plant, but is typically between 30 and 60 pairs. There are varying numbers of electrolysis cells in the plants. A typical anode dissolution takes from 14–21 days, the cathode cycle being 7–10 days.

The production capacity of the electrolysis plant is dependent on the amperage applied in electrolysis, on the number of electrolysis cells and on the time and current efficiency. The efficiencies describe how well in terms of time the cells in the plant are in use (by current) and how efficiently the electric current is used in the precipitation of the copper. The capacity of the electrolysis plant is increased by raising the current density, by building more electrolysis cells or by improving efficiencies.

Anode passivation sets the limit for the increase in current density, especially when using direct current (DC). During passivation, an insoluble layer forms on the surface of the anodes which layer hinders the dissolution reaction. In addition to the current density applied, the composition and the temperature of the electrolyte and in particular the composition of the anodes, all have an effect on passivation. Anode passivation causes losses in cathode copper production, increases energy consumption in the electrolysis process and impairs the quality of cathode copper.

Periodic current reversal technology (PCR), as described e.g. in GB patent 1157686 and in U.S. Pat. No. 4,140,596, is used in some copper electrolyses to raise cathode production capacity. The technology enables the current density applied to be raised in comparison to traditional direct current (DC) electrolysis.

Periodic reversal current technology is based on the reversal of the electrolytic current periodically. In this case the electrolysis is run for a certain time period (plus pulse, forward pulse) so that the copper dissolves from the anodes and precipitates onto the cathodes. After this period there follows a shorter time period, whereby the direction of the current is reversed (minus pulse, reverse pulse). The lengths of the pulses are typically 10–200 seconds in the plus pulse and 0.5–20 seconds in the minus pulse. The ratios for the lengths of the pulses are generally 20/1–30/1. The amperage used in a plus pulse is, by and large, greater than in a minus pulse.

The use of periodic reversal current technology is based on the decrease of the copper content of the electrolyte in the anode slime layer during the minus pulse. This prevents precipitation of copper sulfate, which is one cause of anode passivation. The decrease in copper concentration also affects the electrolyte acidity of the anode surface locally. This can further significantly affect the stability of the copper oxide coating of the anode surface, which also has a fundamental effect on the anode passivation phenomenon. With the aid of periodic reversal current technology, it has been possible to raise the current densities applied in electrolysis up to 400 $A/m^2$ with no anode passivation.

Traditional PCR technology operates in such a way that the length of the plus and minus pulses and the amperages are set manually, after which they follow each other in a similar way, independent of the pulse of the electrolysis process. In this case, the changes in e.g. the chemical quality of the anode can bring about anode passivation at the run parameters used and especially at elevated current densities in operation. Changes in anode quality can happen very fast.

In the method according to this invention, the above-mentioned difficulty with traditional PCR technology, i.e. slowness of process control, has been overcome. According to the present invention the plus and minus pulses applied in the process do not need to be of equal magnitude, but are automatically adjusted according to the respective state in the process. The state of the process, in relation to the dissolution of the anodes, can be monitored easily and simply on the basis of electrolysis cell voltage and the current reversal can be adjusted according to this. An increase in cell voltage is a sign of incipient anode passivation and at the same time it gives an indication of the current reversal required. Accordingly, the lengths of the pulses and the amperages are no longer constant, according to the present method, but are automatically adjusted by the control logic of the power source according to the changes, particularly a rise in cell voltage, occurring in the process. The essential features of the present invention are set forth in the attached claims.

By following the changes in cell voltage of the electrolysis cells, the length of the PCR pulses and/or the amperage can be changed automatically. The cells in an electrolysis plant are normally divided into sections. Different sections can be included in the same or in different electrical circuits, depending on the number of power sources in the plant. Monitoring of changes in cell voltage can take place accordingly by cell, half-section or section or by circuit. Thus the process can be run the whole time at maximum possible current depending on the state of the process conditions.

Figure 1B:
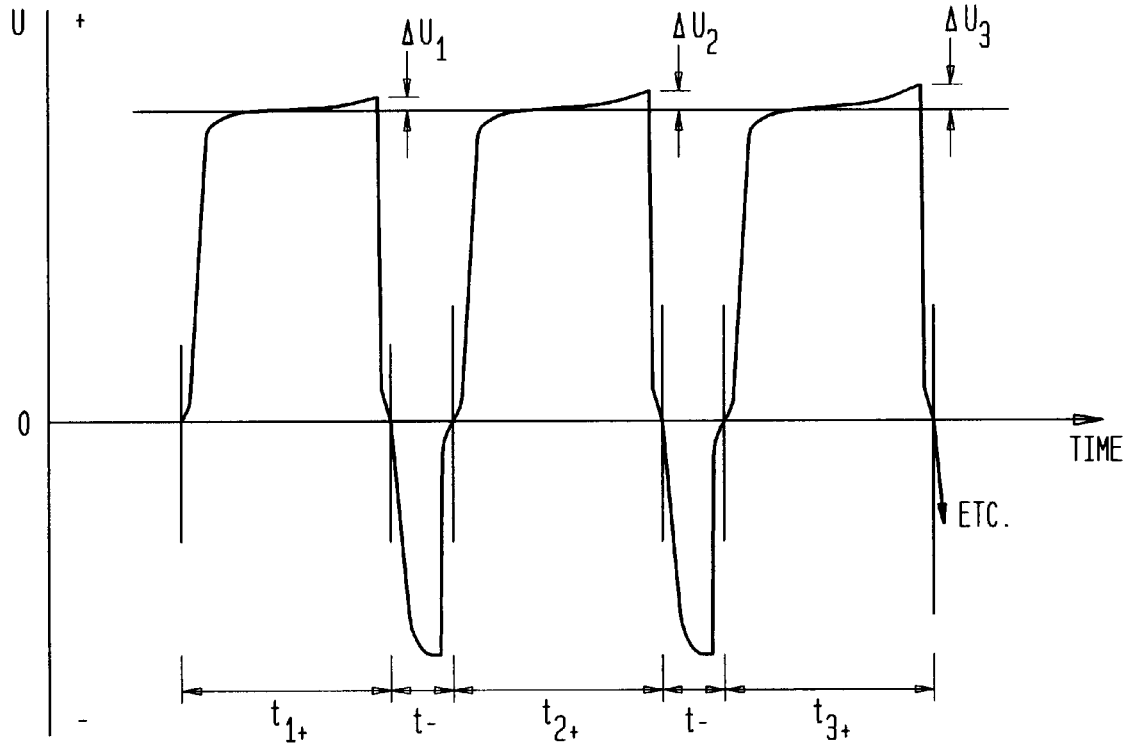
Figure 2A:
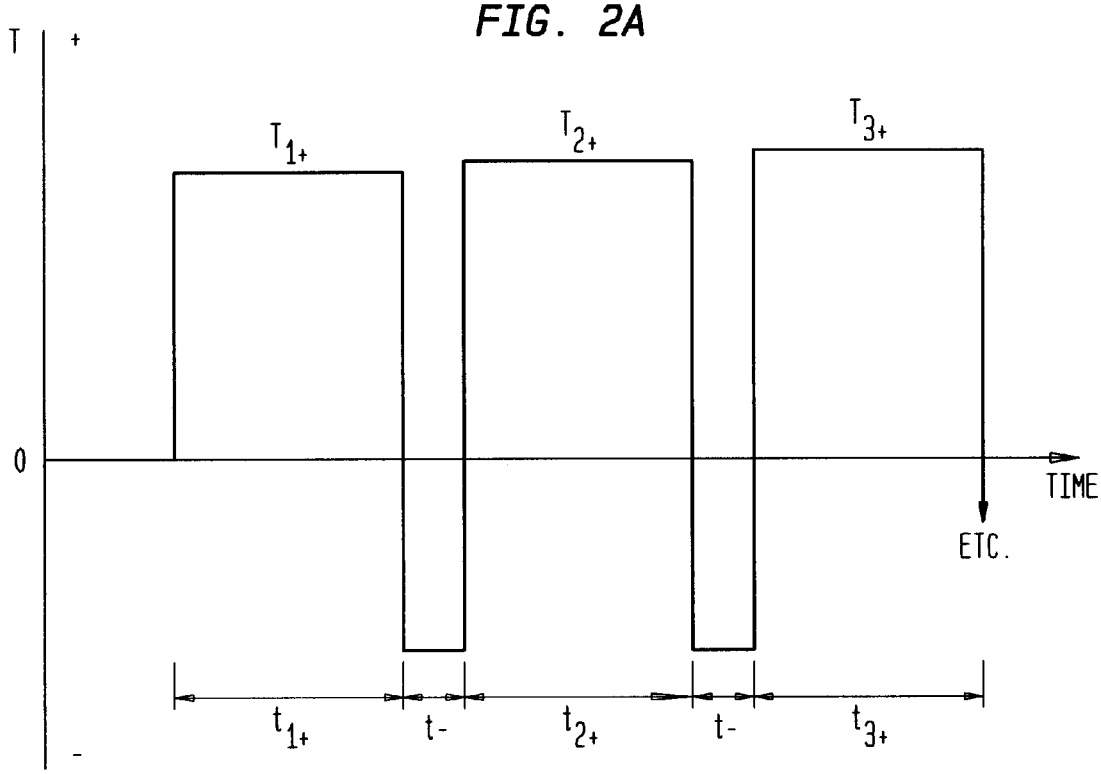
Figure 2B:
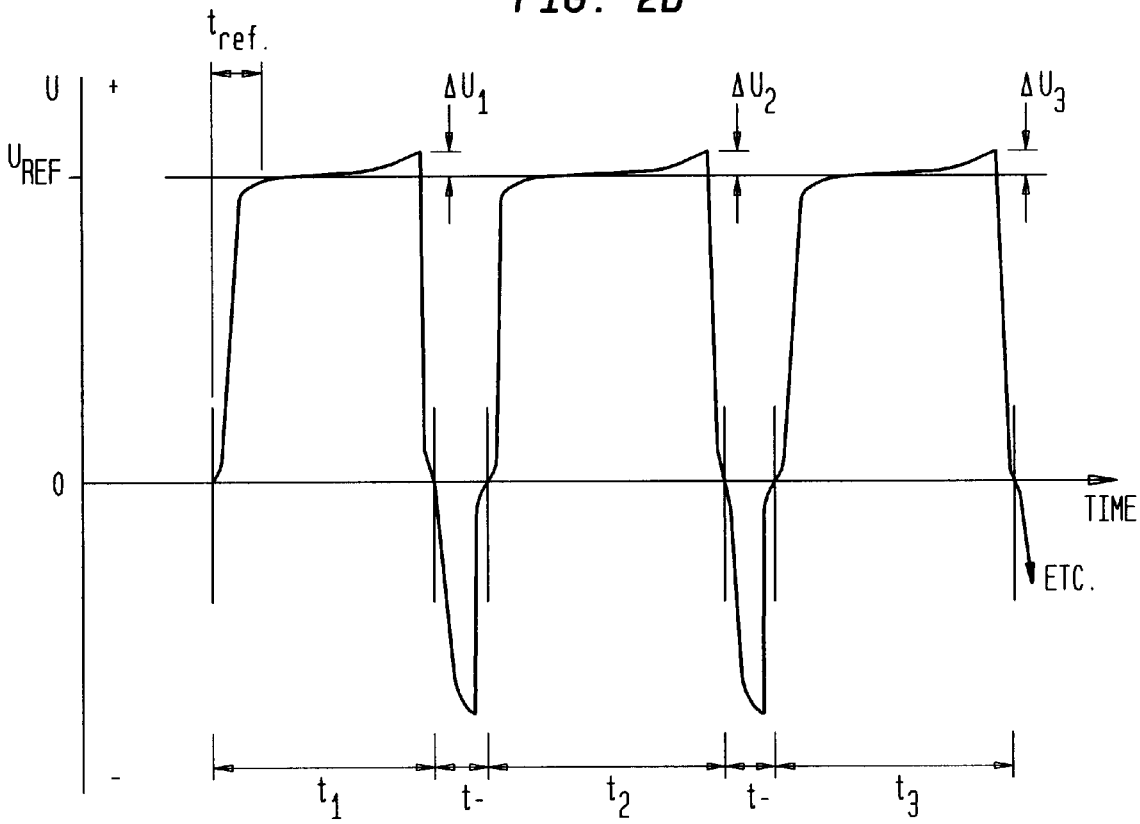

The present invention is described further in the schematic current and voltage diagrams of an electrolysis, where FIG. 1A illustrates the current curve according to the traditional PCR technology, FIG. 1B shows the corresponding voltage curve, FIG. 2A shows an example of an irregular PCR technology current curve according to the present invention, and in FIG. 2B, an example of the corresponding voltage curve.

As can be seen in FIG. 1A and 1B, in conventional PCR technology all variables, such as the current of the plus and minus pulse ($I_+$ and $I_-$) and the length of the plus and minus pulse ($t_+$ and $t_-$) are set at constant values. The setting is done manually and the rectifier control repeats them as standard, i.e. $t_{1+}=t_{2+}=t_{3+}$ etc and $I_{1+}=I_{2+}=I_{3+}$ etc, until they are changed manually. As can be seen in voltage curve 1B, the voltage can change, however, ($\Delta U$) during the plus pulse, as $\Delta U_3$ is clearly greater than $\Delta U_1$. As the changes must be done manually, which is slow, the process may drift into an unwanted state. This happens particularly in passivation situations.

Irregular PCR technology is based on the consideration that during an anode passivation the voltage curve can rise quite considerably during the plus pulse. As seen in FIGS. 2A and 2B, the rise in voltage is maintained as an indicator for the length of the plus pulse and accordingly, for the commencement of the minus pulse. It can be seen from the figures that the length of the plus pulse and the current during the plus pulse can vary, i.e. $t_{1+} \neq t_{2+} \neq t_{3+}$ etc and $I_{1+} \neq I_{2+} \neq I_{3+}$ etc, but the rise in voltage ($\Delta U$) within a certain limit is kept constant, i.e. $\Delta U_1 = \Delta U_2 = \Delta U_3$ etc. The voltage ($U_{ref}$) is the measuring reference set for the rise in voltage, which is a sufficiently long time from the commencement of the current reversal of the plus pulse to follow. The fixing of the voltage determines the time, in practice it can be set as a constant and its length is a number of seconds ($t_{ref}$). This reference voltage is then measured at every plus pulse. When the voltage of the plus pulse rises sufficiently in regard to this reference voltage, a current reversal is carried out.

Certain limitations, which mainly concern the duration and amperage of the plus pulse, can be set to adjust of the plus pulse. This is because the plus pulse can, under favorable conditions, continue for quite a long time, whereby the weight of the anodes is no longer sufficient for a full-length anode cycle and the section to be adjusted has to be prematurely short-circuited due to too thin anodes.

In adjustment, it makes sense primarily to limit from the time periods the minimum and maximum lengths for the plus pulse, whereupon the power source runs a steady current between a fixed minimum and maximum length. If the minimum and maximum time limits reached are sufficiently frequent and of long enough duration, the amperage can be decreased or increased at the set step of current. It is also sensible to set minimum and maximum limits for the amperage to be used. In the same way, it is worthwhile to set limits for the rate of current change. This applies especially to an increase in current, which should preferably take place in rather small steps. In practice the power source runs at the plus pulse time and amperage limits that have been set, changing the amperage at set steps. Once the limits are set, control logic runs automatically without manual adjustment.

In general the minus pulse is so short that it does not necessarily need any adjustment, but its duration and amperage can be kept as standard, as in traditional PCR technology. However, this pulse can also be taken into the adjustment circuit if desired. Adjustment requires, however, priorization to other variables. Adjustment can be build in such a way that when the power source runs for a sufficiently long time at the minimum limit of the plus pulse duration and amperage, the length of the minus pulse or the amperage is increased.

The present invention is further described with the aid of the enclosed example.

EXAMPLE 1

The PCR technology according to the present invention was tested in commercial-scale tankhouse with a PCR power source, onto which a control logic was built according to the present invention. The power source could be also run on traditional PCR technology. The reduction of cathode copper took place onto copper starting sheets and the anodes were normal production anodes used by the plant. The anode cycle used was 16 days, the cathode cycle being 8 days. Changes in voltage were monitored from the whole current circuit of the power source. The circuit contained 300 electrolysis cells.

The main components of the anodes used and their percentages were as follows:

| | |
|---|---|
| Copper | approx. 99.2% |
| Nickel | 0.12–0.48% |
| Arsenic | 0.15–0.35% |
| Antimony | 0.012–0.057% |

The main components and their amounts in the electrolyte were:

| | |
|---|---|
| Copper | 59–64 g/l |
| Sulfuric acid | 145–152 g/l |
| Nickel | 16–18 g/l |
| Arsenic | 12–14 g/l |

The run parameters of the PCR power source were set as follows:

| | |
|---|---|
| Plus pulse maximum length | 35 s |
| Plus pulse minimum length | 10 s |
| Plus pulse maximum current | 19.5 kA |
| Plus pulse minimum current | 18.0 kA |

Reference voltage measurement time 5 s from current reversal

Permitted circuit total voltage increase 5 V

| | |
|---|---|
| Current of minus pulse | 10 kA |
| Length of minus pulse | 0.7 s |

At the beginning of the test cycle a minimum current of 18 kA was set as the starting current of the power source. The increase in voltage at this current was only 1.5 V for a length of 35 seconds of the plus pulse, whereby during the 10-minute period set the maximum limit of the plus pulse length was continually hit. Control unit began to raise the current in the set 0.1-kA steps, the duration of the plus pulse still being 35 s. When there were no longer enough collisions with the maximum limit of the plus pulse time length, the current was no longer raised. The power source remained at the maximum limit of the given current and time pulses until the end of the test cycle. These maximum limits were determined on the basis of the weight of the anodes being used.

No anode passivation whatsoever was noticed during the test. The cathode copper produced was high quality and its copper content was 99.998% When comparing the method according to the present invention to the previous run style by traditional PCR technology, it can be ascertained that both the length of the plus pulse and the amperage could be raised in relation to previously with no fear of sudden anode passivation. The rise in current increased cathode copper production in that electrical circuit.

What is claimed is:

1. A method for using periodic current reversal technology in the electrolytic refining of impure anode copper in one or more electrolysis cells having anode(s) and cathode(s), comprising:

dissolving impure copper, with the aid of an electric current, in a sulfuric acid-based copper sulfate solution;

reducing the dissolved copper from the anode(s) onto the cathode(s) as pure copper; and applying irregular periodic current reversal technology by measuring the electrolysis cell voltage and reversing the current direction each time there is a preselected increase in the measured electrolysis cell voltage, whereby passivation of the anode(s) is prevented.

2. A method according to claim 1, wherein the length of time pulses are adjusted whenever the preselected increase in the measured cell voltage is reached.

3. A method according to claim 2, wherein the length of plus pulses are adjusted whenever the preselected increase in the measured cell voltage is reached.

4. A method according to claim 1, wherein the amperage is adjusted whenever the preselected increase in the measured cell voltage is reached.

5. A method according to claim 1, wherein the irregular periodic current reversal technology is carried out with the aid of automatic control logic of a power source.

* * * * *